US009964306B2

(12) United States Patent
Hain et al.

(10) Patent No.: US 9,964,306 B2
(45) Date of Patent: May 8, 2018

(54) GLOW PLUG

(75) Inventors: Rainer Hain, Steinheim an der Murr (DE); Martin Allgaier, Ludwigsburg (DE)

(73) Assignee: BORGWARNER BERU SYSTEMS GMBH, Ludwigsburg (DE)

( * ) Notice: Subject to any disclaimer, the term of this patent is extended or adjusted under 35 U.S.C. 154(b) by 187 days.

(21) Appl. No.: 13/128,933

(22) PCT Filed: Nov. 25, 2009

(86) PCT No.: PCT/EP2009/008402
§ 371 (c)(1),
(2), (4) Date: May 12, 2011

(87) PCT Pub. No.: WO2010/060616
PCT Pub. Date: Jun. 3, 2010

(65) Prior Publication Data

US 2011/0215080 A1 Sep. 8, 2011

(30) Foreign Application Priority Data

Nov. 27, 2008 (DE) ..... 10 2008 059 405

(51) Int. Cl.
*F23Q 7/00* (2006.01)
*F23Q 7/22* (2006.01)

(52) U.S. Cl.
CPC ..... *F23Q 7/001* (2013.01); *F23Q 2007/004* (2013.01)

(58) Field of Classification Search
CPC ..... F23Q 7/00; F23Q 2007/004; F23Q 7/001; F23Q 7/22; H01T 13/00; H01T 13/02; H01T 13/04; H01T 13/40
(Continued)

(56) References Cited

U.S. PATENT DOCUMENTS 4,499,366 A 2/1985 Yoshida et al.
4,650,963 A 3/1987 Yokoi
(Continued)

FOREIGN PATENT DOCUMENTS

DE 613 426 A 5/1935
DE 102 49 408 A1 6/2003
(Continued)

*Primary Examiner* — Michael G Hoang
(74) *Attorney, Agent, or Firm* — Hackler Daghighian Martino & Novak

(57) ABSTRACT

The invention relates to a glow plug comprising a housing, a ceramic pencil-type glow element which projects from the housing with a first end and is arranged inside the housing with a second end, a feed line which is arranged in the housing and leads to the pencil-type glow element, and a sleeve-type element which surrounds a section of the pencil-type glow element projecting from the housing. The invention is characterized in that the pencil-type glow element has a section surrounded by the housing which section tapers towards the second end, the pencil-type glow element is encircled by a contact element in the housing, which contact element has a section that narrows towards the second end of the pencil-type glow element, said narrowing section encircling at least a subsection of the tapered section of the pencil-type glow element. The invention further relates to a method for producing said glow plug.

18 Claims, 26 Drawing Sheets

(58) Field of Classification Search
USPC ..... 219/260–270; 123/169 R
See application file for complete search history.

(56) References Cited

U.S. PATENT DOCUMENTS

| | | | | |
|---|---|---|---|---|
| 5,084,607 | A | 1/1992 | Shafer et al. | |
| 5,589,091 | A * | 12/1996 | Muller | 219/270 |
| 5,880,432 | A | 3/1999 | Radmacher | |
| 6,013,898 | A | 1/2000 | Mizuno et al. | |
| 6,727,473 | B2 * | 4/2004 | Taniguchi et al. | 219/270 |
| 2002/0153365 | A1 | 10/2002 | Taniguchi et al. | |
| 2005/0104496 | A1 | 5/2005 | Ando | |
| 2005/0284860 | A1 | 12/2005 | Yoshikawa et al. | |
| 2006/0053875 | A1 | 3/2006 | Haussner et al. | |
| 2007/0245806 | A1 | 10/2007 | Hirose et al. | |
| 2009/0165739 | A1 | 7/2009 | Kern et al. | |
| 2009/0321408 | A1 | 12/2009 | Kern et al. | |
| 2010/0000982 | A1 | 1/2010 | Allgaier et al. | |
| 2012/0043309 | A1 | 2/2012 | Cheng et al. | |

FOREIGN PATENT DOCUMENTS

| | | | | |
|---|---|---|---|---|
| DE | 103 43 521 | A1 | 4/2005 | |
| DE | 102006016566 | * | 3/2007 | F23Q 7/00 |
| DE | 102006016566 | A1 * | 3/2007 | F23Q 7/00 |
| DE | 10 2006 018 606 | A1 | 7/2007 | |
| DE | 102008009429 | A1 * | 9/2008 | F23Q 7/00 |
| DE | 10 2009 048 643 | A1 | 3/2011 | |
| EP | 0 648 977 | A2 | 4/1995 | |
| EP | 1 881 315 | A2 | 5/2007 | |
| EP | 1881315 | A2 * | 1/2008 | G01L 23/22 |
| JP | 59 001 927 | A | 1/1984 | |
| JP | 2002 243 150 | A | 8/2002 | |
| JP | 2002 257 341 | A | 3/2004 | |
| JP | 2005 180866 | A | 7/2005 | |

* cited by examiner

| | contact ring IIc | contact ring IIa | | |
|---|---|---|---|---|
| sleeve/pencil | with chamfer | cylindrical | with chamfer | with conical tapering |
| without | Fig.10 | Fig.11 | Fig.12 | Fig.13 |
| fitted with play | Fig.14 | Fig.15 | Fig.16 | Fig.17 |
| press-fitted an front end | Fig.18 | Fig.19 | Fig.20 | Fig.21 |
| shrink-fitted on front end (hot-pressed) | Fig.22 | Fig.23 | Fig.24 | Fig.25 |
| with positive fit | Fig.26 | Fig.- | Fig.27 | Fig.28 |
| with positive fit press-fitted | Fig.29 | Fig.- | Fig.30 | Fig.31 |
| with positive fit shrink-fitted on front end | Fig.32 | Fig.- | Fig.33 | Fig.34 |

Fig. 41

GLOW PLUG

The invention relates to a glow plug having the features presented in the preamble of Claim 1. Such glow plugs are, for example, known from DE 10 2004 055 218 A1, EP 1 239 222 B1 and JP 2002 243 150 A.

Such glow plugs are to disadvantage in that the tips of the ceramic heater—which is also referred to as glow pencil—can break off during operation and cause heavy consequential damage.

The invention aims at showing a way how this risk of breakage can be reduced.

This problem is solved by a glow plug having the features presented in claim 1. Advantageous refinements of the invention are the subject matter of subordinate claims.

The contact element of a glow plug according to the invention can be manufactured by lathe-cutting with high dimensional accuracy and allows a simple design of the contact surface. As a result, the glow pencil can be positioned and connected more precisely. In particular, a surface of the contact element that has been manufactured by machining, for example, lathing, drilling or reaming, can be contacted very well.

The connection of the contact element to the glow pencil can, for example, be established by pressing or shrink fitting. Preferably, the contact element is brazed or soldered to the glow pencil. The contact surface of a contact element according to the invention can be designed in an advantageously easy manner and wetted with brazing or solder material very easily.

In a glow plug according to the invention, the glow pencil can be electrically contacted by a contact element, with the result that the sleeve does not have to assume this function and can be optimized with regard to its function of protecting the glow pencil. The contact element is to advantage in that it can be produced with low manufacturing tolerances and can be contacted, e.g. brazed or soldered, to the glow pencil. A relatively small contact surface between glow pencil and contact element is sufficient for electric contacting, said contact surface allowing a simple yet high-quality brazed or soldered connection. Small brazing and soldering surfaces can be completely immersed by an inert shielding gas at low expenses, for example argon. For this reason, harmful influences of air and oxidation products of evaporating contaminants can be kept away from the brazing or solder material during the brazing or soldering process. It is, therefore, advantageously possible to produce tight brazed or soldered connections in a safer way, said tight brazed or soldered connections being free from encapsulated cavities. Crack nuclei which may cause a breakage of the glow pencil during future use of the glow plug can, therefore, be prevented to a great extent. For this reason, the risk of breakage is reduced in glow plugs according to the invention. Since the sleeve and the contact element are designed as independent components, there is the possibility of manufacturing the components from different materials. Preferably, each component consists of a material that has been optimized for the particular function; for example, the sleeve can be manufactured from a high temperature resistant steel, for example, Inconel while a more cost-effective steel can be used for the contact element. Functional risks which are caused by combined functions are minimized. When a short component is brazed or soldered, the surface to which air can adhere is minimized, this resulting in clean soldered connections.

Preferably, the tapering section of the glow pencil is conical. Preferably, the narrowing section of the contact element is conical. With particular preference, the taper angles of these two conical sections are identical. It is, however, also possible to design these two sections conically with differently shaped taper angles; particularly, deviations of less than 5° are of only low significance. It is also possible to design one or even both sections with a shape that is different from a cone. If the contact element is connected to the glow pencil by press-fitting, preferably the aperture angle of the narrowing section of the contact element is smaller than the aperture angle of the tapering pencil section. If both the narrowing section of the contact element and the tapering pencil section are conical, press-fitting can be achieved particularly advantageously if the aperture angle of the conical section of the contact element is smaller than the aperture angle of the cone of the pencil section by 0.1° to 2°, preferably 0.2° to 1°.

Preferably, the glow pencil projects through the contact element, with the result that the brazed or soldered connection can be established at low expenses.

Preferably, the contact element is designed as a ring or a sleeve. In this manner, the glow pencil can, advantageously, be enclosed all around. If a sleeve is used as contact element, said sleeve is, preferably, short and has, for example, a length that is less than three times, preferably no more than two times its greatest diameter.

An advantageous refinement of the invention provides that at least one annular space is provided between the contact element and the glow pencil, forming a buffer for brazing or soldering material for receiving excessive brazing or soldering material. Preferably, the annular space forming the buffer is partially filled with brazing or soldering material and, starting from one end of the contact element, narrows towards the other end of the contact element. Preferably, there are two narrowing annular spaces, wherein one of these spaces tapers towards the first end of the glow pencil and the other one tapers towards the second end of the glow pencil.

The contact element can form a buffer for brazing or soldering material at the cone of the contact ring and a buffer at the shaft of the contact ring, thus providing a space for the brazing or soldering material where it can accumulate at the transition to the cone.

Another advantageous refinement of the invention provides that the contact element abuts on the sleeve, more particularly, is arranged such that it overlaps the sleeve. Although, as a matter of principle, the sleeve can also be arranged spaced apart from the contact element, the mechanical load on the glow pencil can be advantageously reduced if the sleeve abuts on the contact element, more particularly, if it is connected to said contact element by welding. An overlapping arrangement facilitates welding.

Preferably, the sleeve is connected to the housing in a gas-tight manner, for example, via a sealing element. In particular, a membrane or a bellows can be used as sealing element. Preferably, the sealing element is connected to the housing and the sleeve in a substance-to-substance-bonding manner, for example, by welding.

Another advantageous refinement of the invention provides that the housing is configured in two parts. In this manner, a sealing element between a rear housing part, i.e., a housing part that is facing away from the combustion chamber, and the sleeve can be protected by a forward housing part. After the sealing element has been mounted, the two housing parts can be joined, for example, by welding.

Another advantageous refinement of the invention provides that the feed line is surrounded by a second sleeve. The second sleeve can be used as an extension of the first sleeve and the contact element, more particularly, of a contact ring. The two sleeves can be manufactured from simple tube sections, separately from each other and from the brazing or soldering area of the functional unit. Preferably, the contact element abuts on the second sleeve, more preferably, the contact element and the second sleeve are arranged such that they are overlapping. In this manner, the contact element can be welded well to the second sleeve.

A vibration damper can be arranged between the second sleeve and the housing. Preferably, the second sleeve has a section with reduced outside diameter for positioning a damping ring.

Preferably, the glow pencil has a ceramic inner conductor and a ceramic outer conductor between which a ceramic isolator is arranged. An end section of the outer conductor and/or the inner conductor can have an increased resistance and form a heater conductor, preferably with PTC characteristics.

Another advantageous refinement of the invention provides that the glow pencil is pressed into the sleeve. For example, the glow pencil can also be connected to the sleeve by brazing or soldering. Press-fitting, however, can be achieved at advantageously low expenses and promotes a long service life of the glow pencil. In particular, the glow pencil can be pressed into a heated sleeve which shrink-fits onto the glow pencil when cooling down. Preferably, the wall thickness of the sleeve decreases towards the first end of the glow pencil, in particular in a tapering region of the glow pencil.

Another advantageous refinement of the invention provides that the sleeve narrows towards the first end of the glow pencil and the glow pencil broadens in the sleeve, as seen from the first end. In this manner, the glow pencil can be held in the sleeve in a form-locking manner in the event of a breakage. Herein, the glow pencil, preferably, comprises a section that is tapering towards its first end, said section being enclosed by a section of the sleeve that narrows towards the first end of the glow pencil.

Furthermore, the invention relates to a method for producing a glow pencil comprising the following steps: attaching a contact element onto a tapering section of a ceramic glow pencil; attaching a connector onto the end of the tapering section of the glow pencil; establishing a contact, preferably by brazing or soldering, of the glow pencil with a narrowing section of the contact element, said narrowing section surrounding the tapering section of the glow pencil; sliding a sleeve onto the glow pencil; and installing in a housing.

Preferably, the connector is attached onto the glow pencil with its inner pole head. Preferably, the connector is brazed or soldered to the glow pencil. As an alternative, however, it is also possible to use a press-fit connection. The sleeve can be connected to the glow pencil, for example, by press-fitting or shrink-fitting.

An advantage of the invention is that it allows the manufacture of products with simple components. The components can be manufactured in a multitude of variants—short or long, thin or thick—to meet the customers' particular demands, however, without any increased logistic complexity. The use of components that are as simple as possible directly leads to parts that can be manufactured in a cost-effective manner. By using a multitude of smaller components, multifunctionality and, therefore, complex reciprocal effects in the functionality can be avoided.

More precise concentricity properties of the components, and even of the primary materials or manufacturing processes of the components as well, result in a more precise concentricity. The combination according to the invention of the simpler components with a more exact geometry and controllable assembly processes result in a more precise and cost-effect workpiece with high durability. The simplification of the components results in a reduction of functional interactions in the individual component.

It is, for example, possible to employ different materials in specific regions. For example, a high temperature resistant material can be used towards the tip of the glow pencil, a material with adjusted temperature expansion coefficient can be used in the region of contacting, and a reasonably priced steel can be used in the region of the supply line. These components can be procured more easily, and the tendency to crack in the ceramics around the soldered joint is reduced.

The invention is to advantage in that it reduces the surface and prevents encapsulated cavities at the components that are brazed or soldered. The only sleeves that are brazed or soldered to the ceramics are short sleeves. These can be easily circulated around by argon, and the brazing or soldering material is kept away from any effect of air and oxidation products of evaporating contaminants. This results in reliable tight soldered connections. If the contact element is processed after brazing or soldering, the assembly capability of the components is improved and the deviations in concentricity on the product are reduced. Therein, the geometry of the contact ring can be changed such that all connection points for the connection method are designed in an optimal manner.

BRIEF DESCRIPTION OF THE DRAWINGS

Below, the invention will be illustrated in more detail by means of the drawings. Therein, components that are equal and corresponding to each other are provided with corresponding reference symbols. In the drawings.

FIG. 41 presents the various variants according to categories.

DETAILED DESCRIPTION

Figure 1:
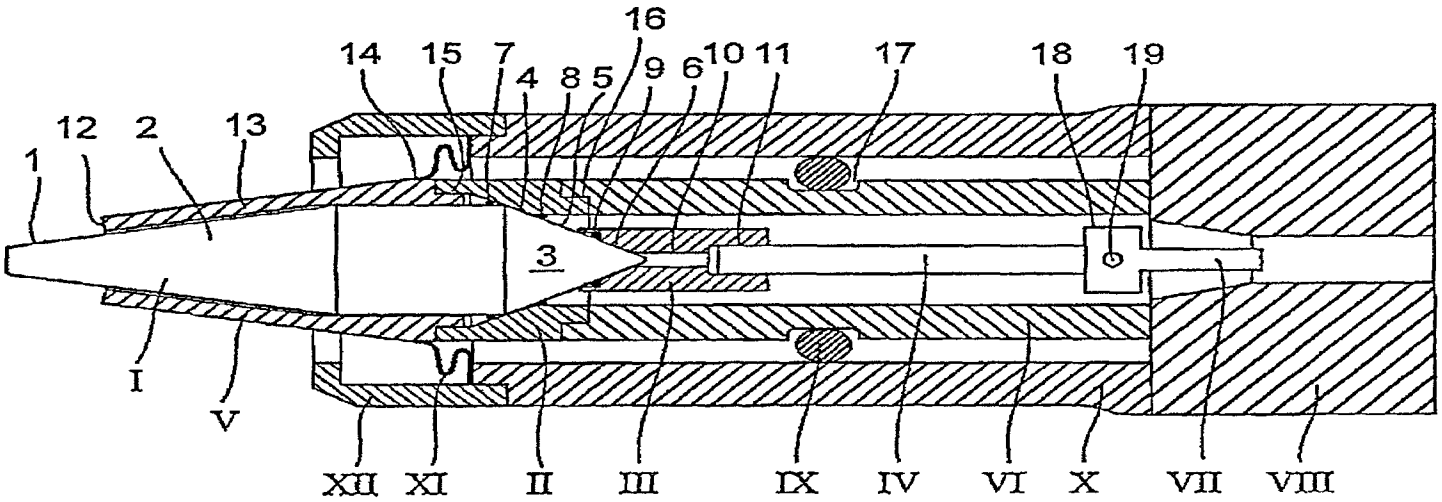
FIG. 1 is a sectional view of a ceramic pressure measuring glow plug.

FIG. 1 shows an exemplary embodiment of a glow plug according to the invention with a ceramic glow pencil I which, surrounded by a sleeve V, projects from a housing that consists of an upper housing body part X and a lower housing body part XII. The glow pencil I has an inner conductor, an outer conductor and an isolator therebetween. The glow pencil tapers towards its end arranged in the housing, preferably in a conical form. For the purpose of electrically contacting the inner conductor of the glow pencil, this end is inserted into an inner pole contact head III that is connected to a feed line IV and to which the glow pencil I is soldered.

The outer conductor of the glow pencil is electrically contacted via a contact element II which, in the exemplary embodiment illustrated, is formed as a ring. The contact ring II is brazed or soldered to the glow pencil I and has a narrowing section which, in the exemplary embodiment illustrated, has a conical interior surface, and comprises a partial section (in the following connecting cone) of the conically tapering section of the glow pencil.

There are two annular spaces between the contact element II and the glow pencil I, which are provided as buffers 7, 8 for receiving excessive brazing or soldering material. However, these annular spaces are, in part, filled with brazing or soldering material and, starting from one end of the contact element II, narrow towards the other end of the contact element.

At one of its ends, the ceramic glow pencil I of FIG. 1 has the glow tip 1 of the ceramic glow pencil, said glow tip 1 being connected to the connecting cone 3 of the ceramic glow pencil via the feed line of the ceramic glow pencil, said connecting cone 3 being particularly shown in FIG. 2*a*. Said connecting cone 3 of the ceramic glow pencil is divided into a connecting cone or connecting cone section 4 for the contact ring II on the ceramic glow pencil, the isolator region 5 on the connecting cone of the ceramic glow pencil and the connecting cone or connecting cone section 6 for the inner pole head III on the ceramic glow pencil.

The connecting cone 4 for the contact ring II on the ceramic glow pencil represents the outer contact; the connecting cone 6 for the inner pole head III on the ceramic pencil represents the inner contact. The contact ring II is seated on the connecting cone 4 for the contact ring II on the ceramic glow pencil; the inner pole head III is seated on the connecting cone 6 for the inner pole head on the ceramic pencil. The feed line IV which is connected to the inner pole head III is inserted into the latter.

The sleeve V which, preferably, consists of a high temperature resistant metal, such as, for example, Inconel, and a further sleeve intended as extension VI are welded to the contact ring II. Therein, the sleeve V and the extension VI are positioned in relation to each other and are arranged such that they each overlap the contact ring II. The glow current connection VII is attached to the feed line IV, with the glow current connection VII, in turn, being connected to the sensor element with plug connection VIII. The sensor element VIII is a pressure sensor, with the result that the glow plug can be used to measure the pressure in the combustion chamber of an engine. A vibration damper, i.e., the damping ring IX, is mounted to the extension VI. For the purpose of positioning the damping ring IX, the further sleeve VI has a section 17 with reduced outside diameter.

The upper body part X was mounted above this entity (heater rod) and connected to the sensor element VIII. A sealing element XI, for example, a bellows, is attached to the upper body part X and to the sleeve V. The sealing element XI seals the two parts against each other and radially holds them in position. The lower body part XII is attached to the upper body part X and completes the whole thing.

The glow current connection VII comprises a welding hole 19 in the joint region 18 of the glow current connection, with the welding energy on the surface of the feed line IV being directed into said welding hole 19. In this manner, the material of the glow current connection VII is secondarily melted-on by the molten mass of the feed line IV instead of being boiled away.

A wrap consisting of an active brazing or soldering material wetting the ceramics is pushed into position in the cone region of the inner pole head III. The ceramic glow pencil is introduced and pressed into this pair of parts. This combination is placed into a precisely manufactured apparatus. An apparatus guides and presses the two components to be brazed or soldered into position in relation to each other from above.

For the purpose of the brazing or soldering operation, the immediate environment of the components is hermetically sealed, for example, by means of a glass casing which is put over the apparatus, wherein a gripper serves as a cover. Argon is circulated into the cavity from below, and the argon escapes through small openings (1 mm hole in the cover, or labyrinth around the grippers) at high speed. After a defined precirculation time has elapsed, the inner pole head is heated until the solder has wetted the two components. In order to obtain uniform heating of the ceramic pencil, a heating casing made of temperature-resistant steel, for example, Inconel can be placed around the glow pencil and also heated in the process. In the next work step, a comparable procedure is followed for the component that has been made and the contact ring II. To achieve this, a suitable brazing or soldering wrap is also positioned into the contacting ring II, the combination is pressed together and is circulated around with argon, heated and brazed or soldered.

The glow pencil thus contacted is a multiple-use part. If mechanically supplemented in an appropriate manner, it can be used as a glow plug in pre-combustion chambers, flame glow plugs and engine-independent air heating systems. If provided with a protective sleeve for the ceramic pencil as a safeguard against coking and an inner pole extension, it can be supplemented to form a ceramic glow plug for high-speed self-igniting engines or, along with a feed line IV and an extension VI, installed to form a heater rod for a pressure measuring glow plug. To achieve this, the sleeve V and the extension VI are clamped into an apparatus. The contacted glow pencil is inserted so that, when the sleeve and the extension are positioned, it will be positioned therebetween. The apparatus now positions the sleeve and the extension in exact relation to the axis and presses the components into each other. Thus guided, the components are laser-welded to each other while being turned. The heater rod that is obtained is straight and, along with a sensor element with plug connection, damping ring, upper body part, bellows, and lower body part, is assembled, e.g., to form a CPSG in known manner.

Figure 2:
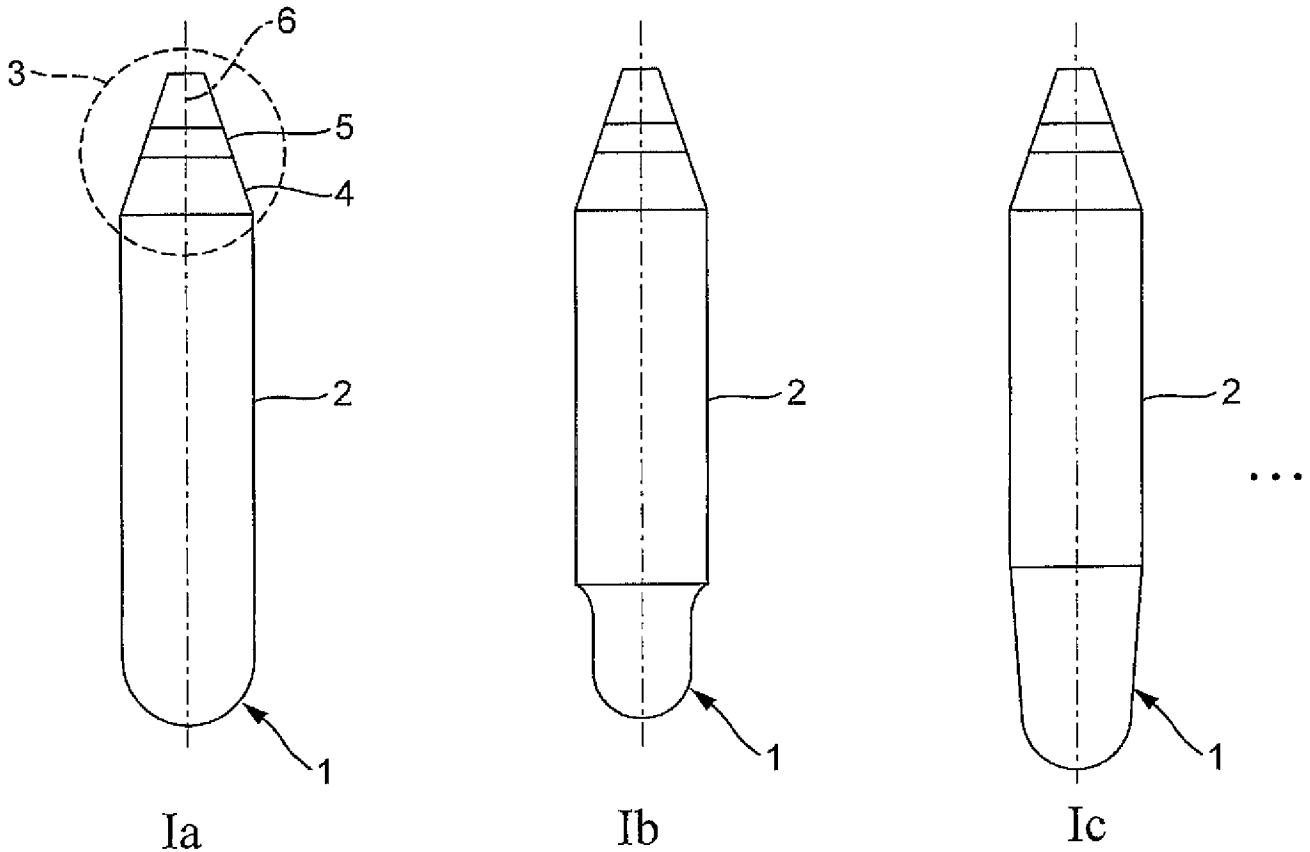
FIG. 2 shows heater or glow pencil variants.

FIG. 2 discloses three different heater or glow pencil variants. In essence, variant Ia has a cylindrical design. Variant Ib comprises a turned-on tip. Variant Ic shows a conical heater tip.

Figure 3:
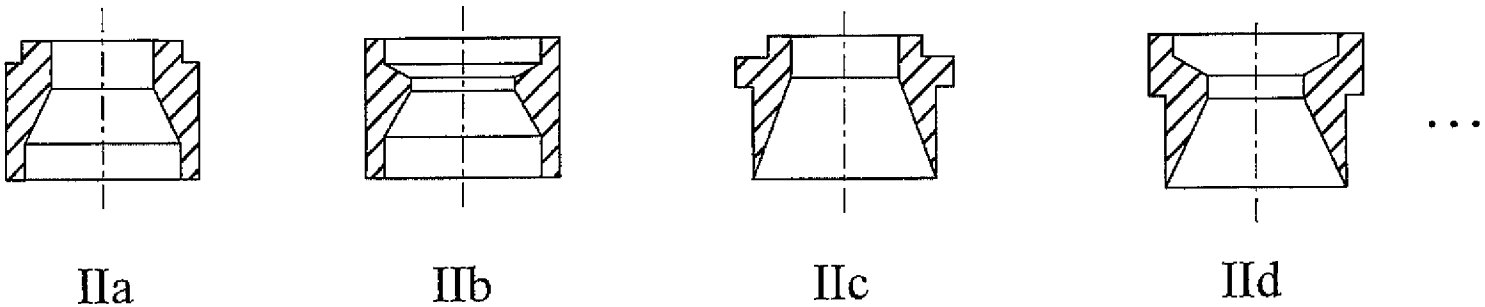
FIG. 3 shows contact ring variants.

FIG. 3 shows four different contact ring variants IIa, IIb, IIc and IId. The illustrated contact rings II each have a narrowing section which, preferably, has a conical form.

A cylindrical section can be arranged adjacent to one side or both sides of the narrowing section, for example, in order to create an annular space as buffer for brazing or soldering material.

Figure 4:
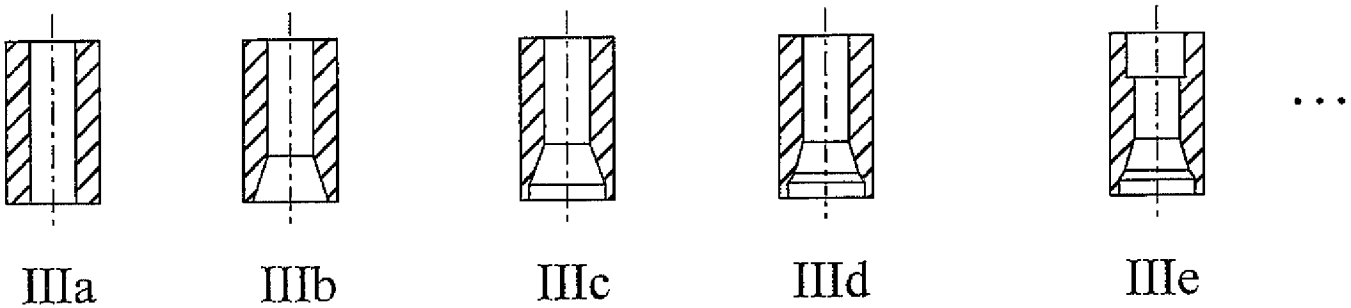
FIG. 4 shows inner pole head variants.
Figure 5:
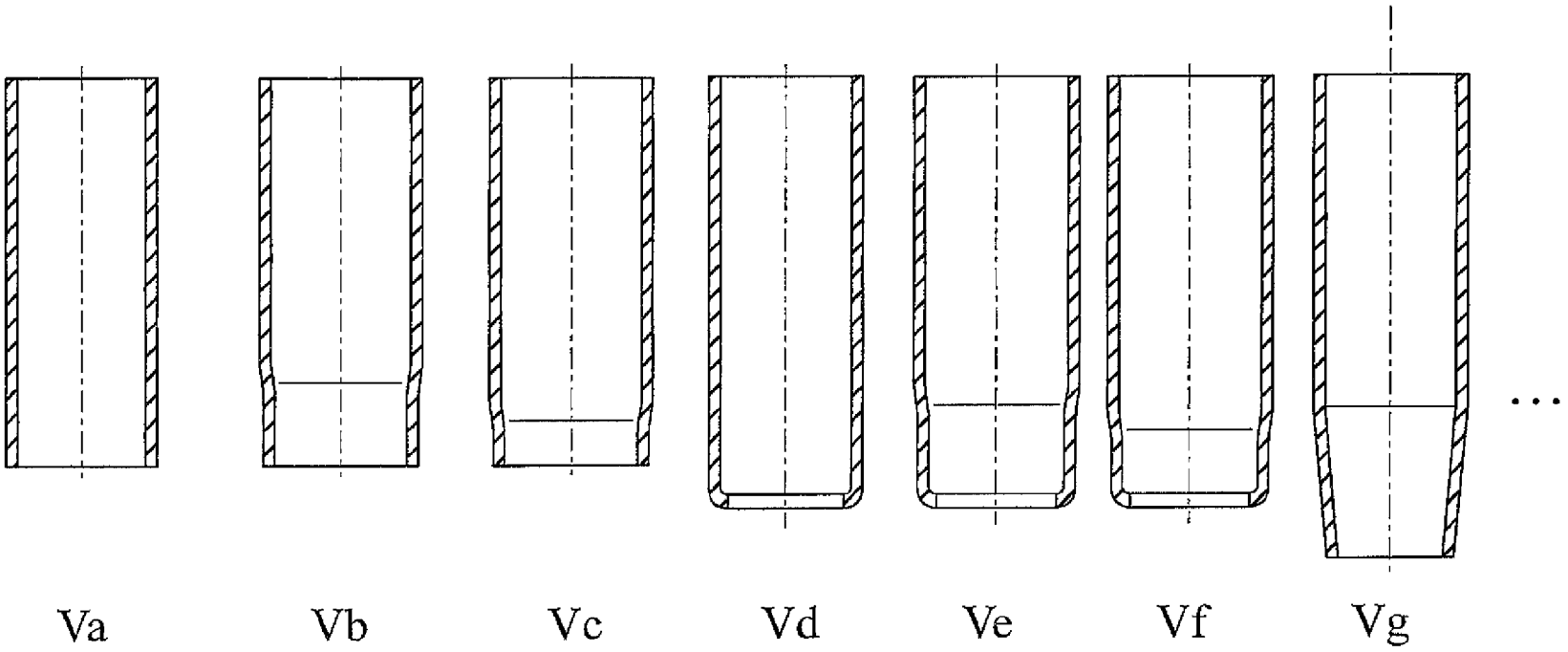
FIG. 5 shows sleeve variants.
Figure 6:
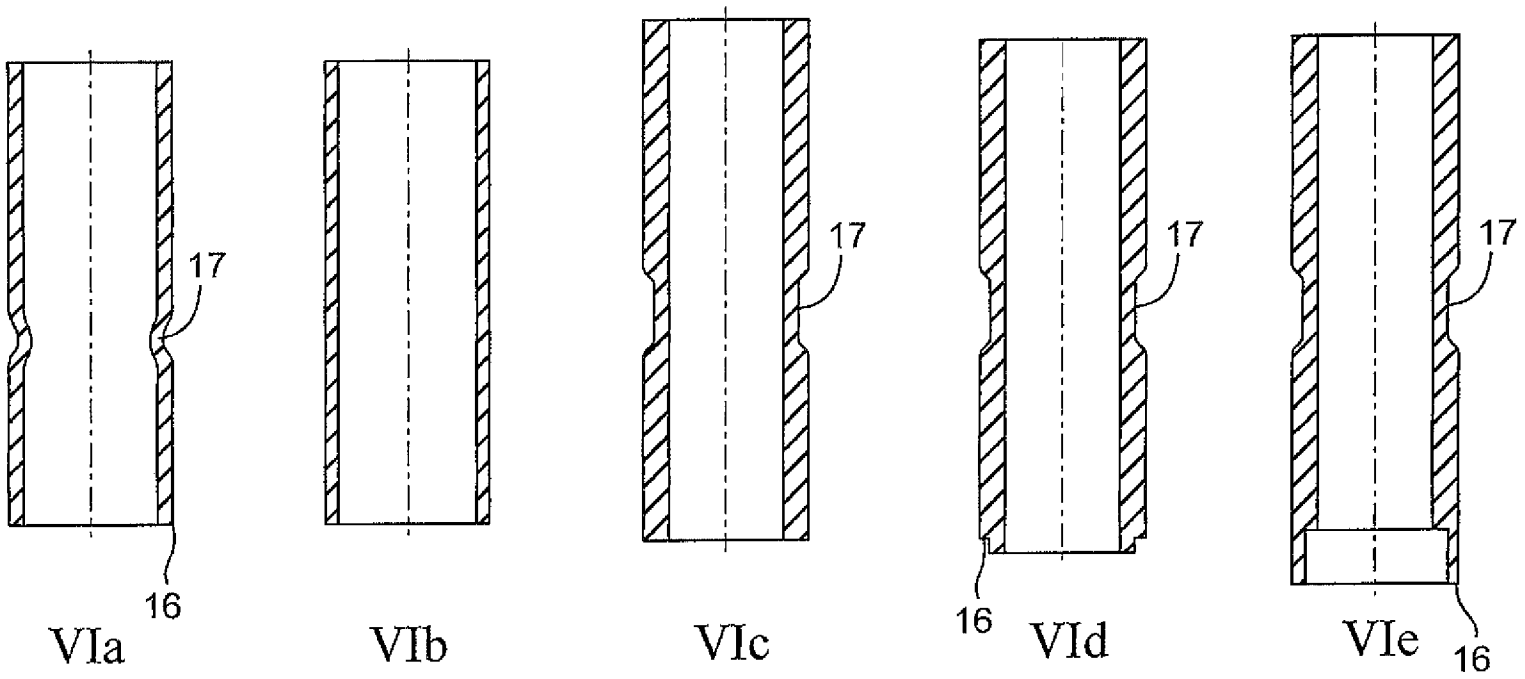
FIG. 6 shows extension variants.

FIG. 4 discloses five variants of inner pole heads IIIa, IIIb, IIIc, IIId, and IIIe. FIG. 5 shows seven different sleeve shapes Va, Vb, Vc, Vd, Ve, Vf, and Vg. FIG. 6 discloses extension variants VIa, VIb, VIc, VId and Vie.

Figure 7:
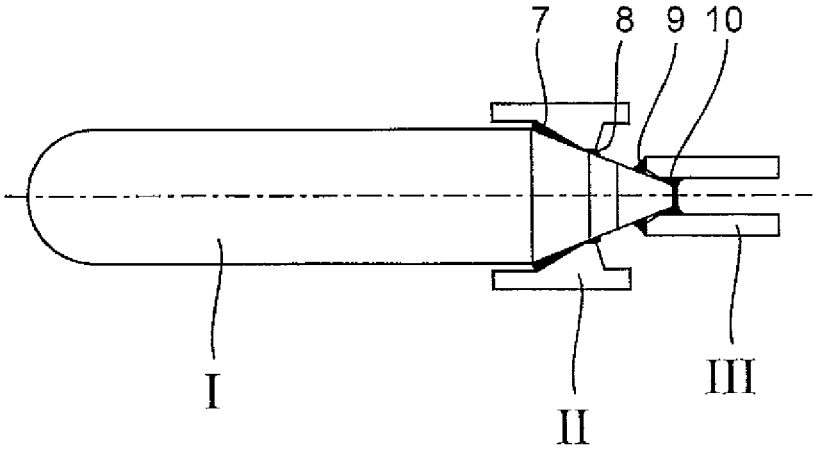
FIG. 7 shows a heater or glow pencil variant with contact ring and inner pole head.
Figure 8:
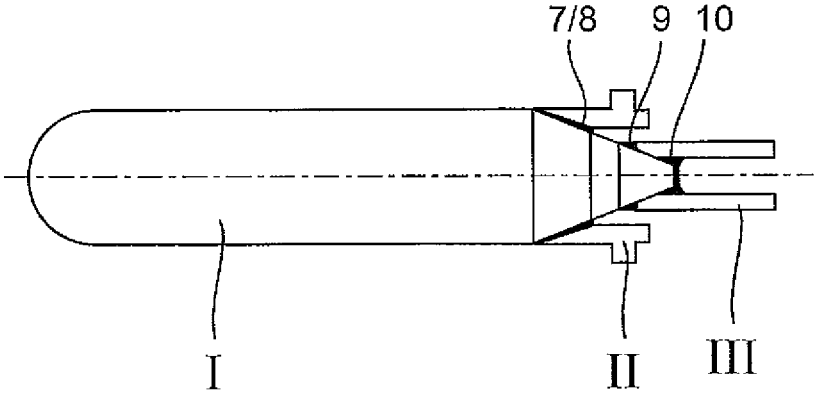
FIG. 8 shows a heater or glow pencil variant with contact ring and inner pole head.
Figure 9:
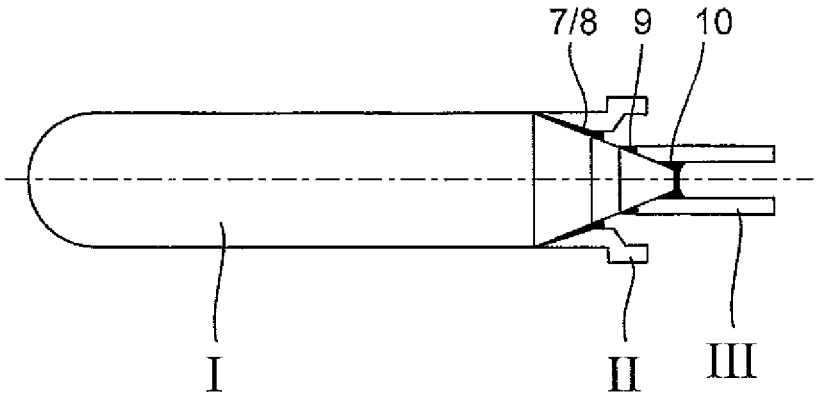
FIG. 9 shows a heater or glow pencil variant with contact ring and inner pole head.
Figure 10:
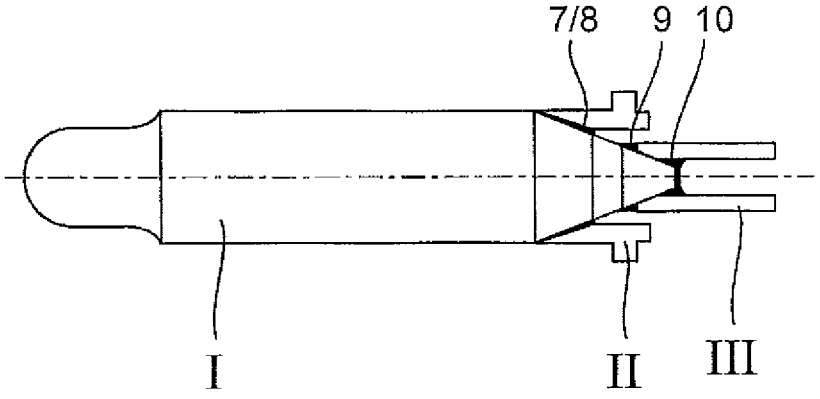
FIG. 10 shows a heater or glow pencil variant with contact ring and inner pole head.
Figure 11:
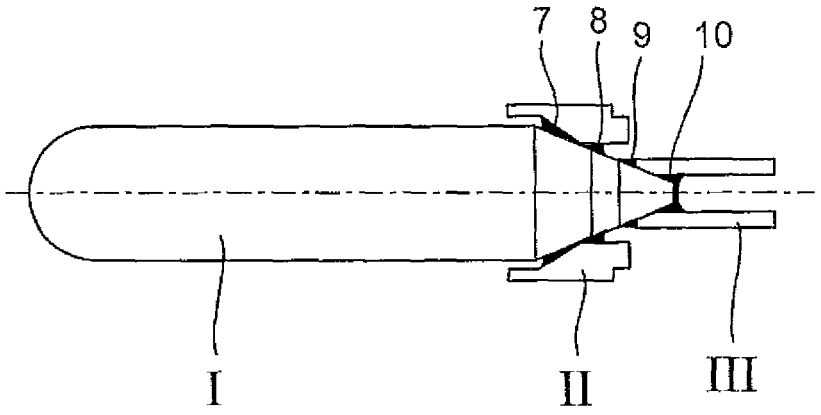
FIG. 11 shows a heater or glow pencil variant with contact ring and inner pole head.
Figure 12:
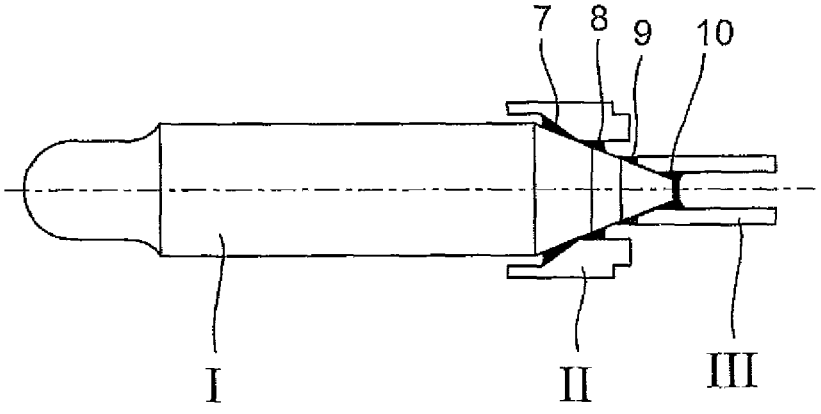
FIG. 12 shows a heater or glow pencil variant with contact ring and inner pole head.
Figure 13:
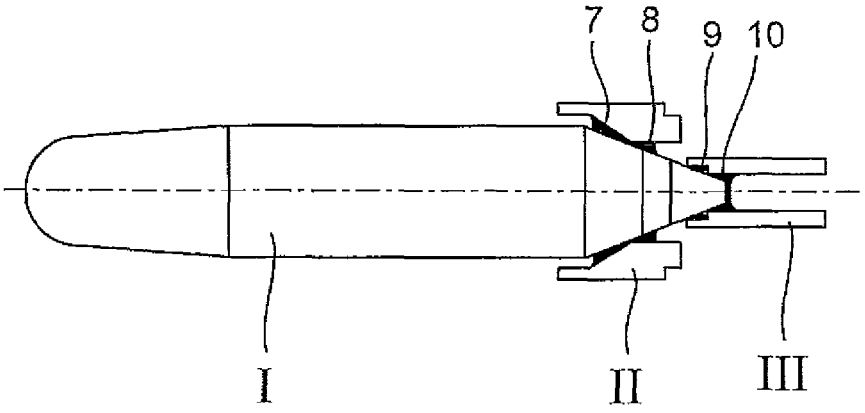
FIG. 13 shows a heater or glow pencil variant with contact ring and inner pole head.
Figure 14:
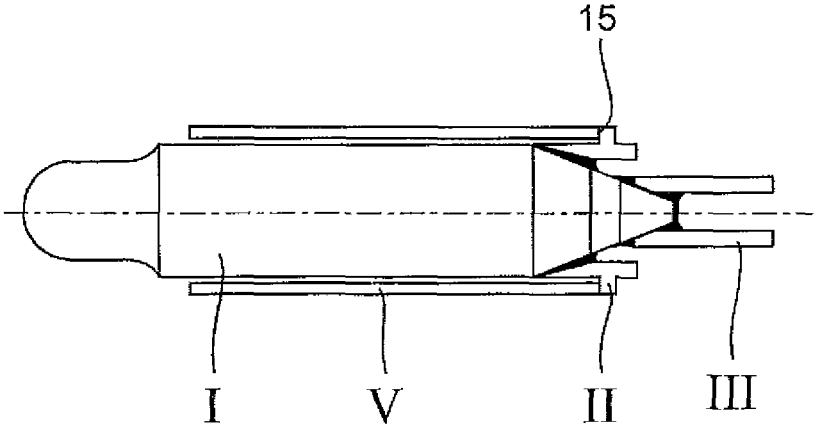
FIG. 14 shows a heater or glow pencil variant with contact ring and inner pole head and sleeve.
Figure 15:
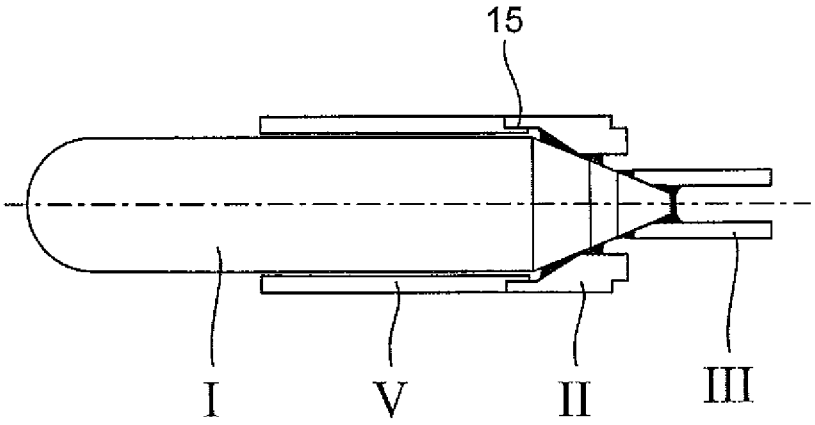
FIG. 15 shows a heater or glow pencil variant with contact ring and inner pole head and sleeve.
Figure 16:
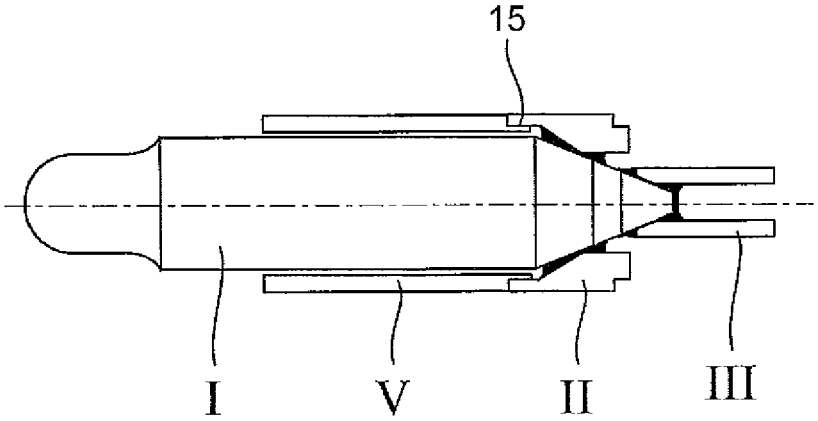
FIG. 16 shows a heater or glow pencil variant with contact ring and inner pole head and sleeve.
Figure 17:
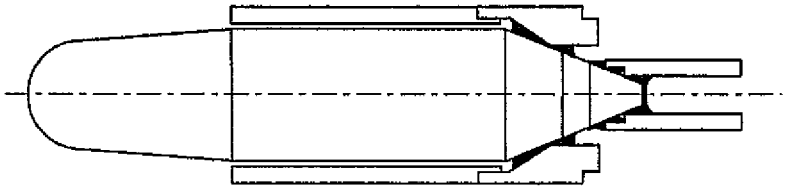
FIG. 17 shows a heater or glow pencil variant with contact ring and inner pole head and sleeve.
Figure 18:
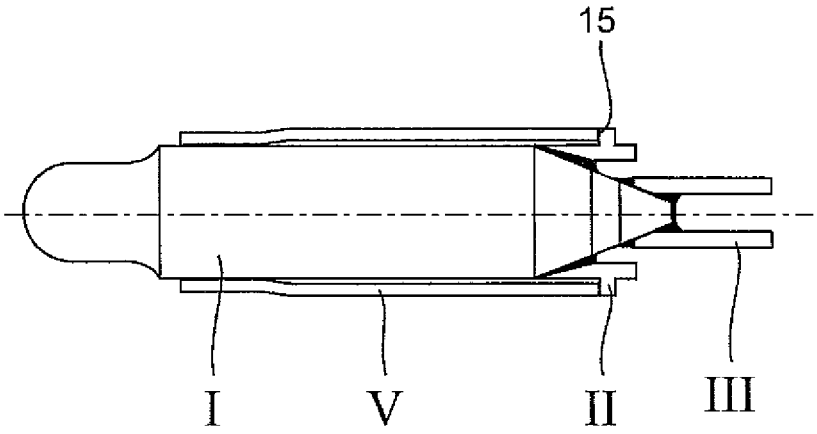
FIG. 18 shows a heater or glow pencil variant with contact ring and inner pole head and sleeve.
Figure 19:
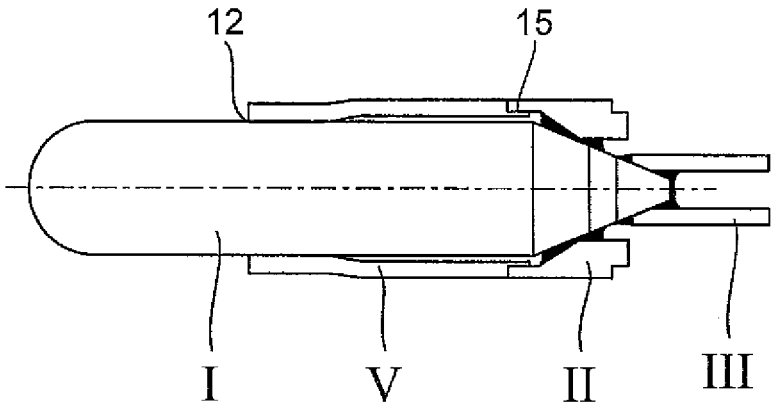
FIG. 19 shows a heater or glow pencil variant with contact ring and inner pole head and sleeve.
Figure 20:
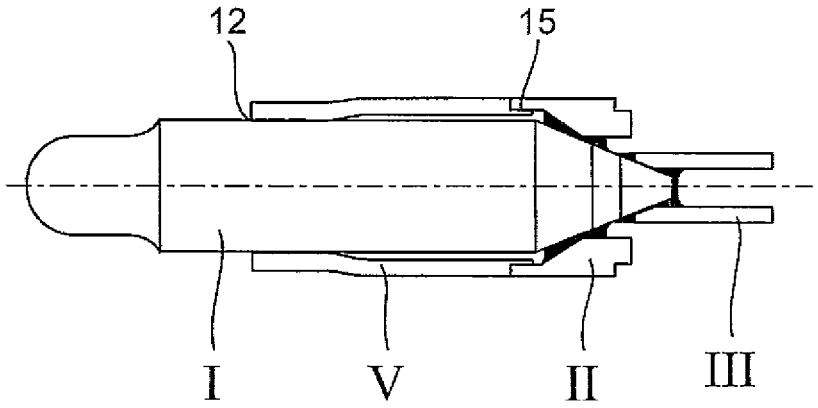
FIG. 20 shows a heater or glow pencil variant with contact ring and inner pole head and sleeve.
Figure 21:
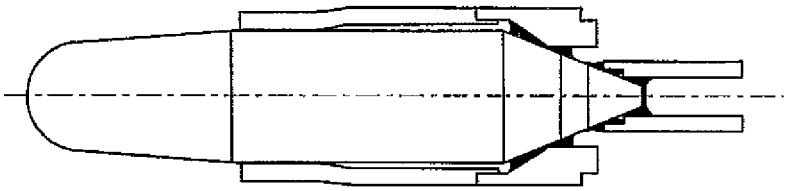
FIG. 21 shows a heater or glow pencil variant with contact ring and inner pole head and sleeve.
Figure 22:
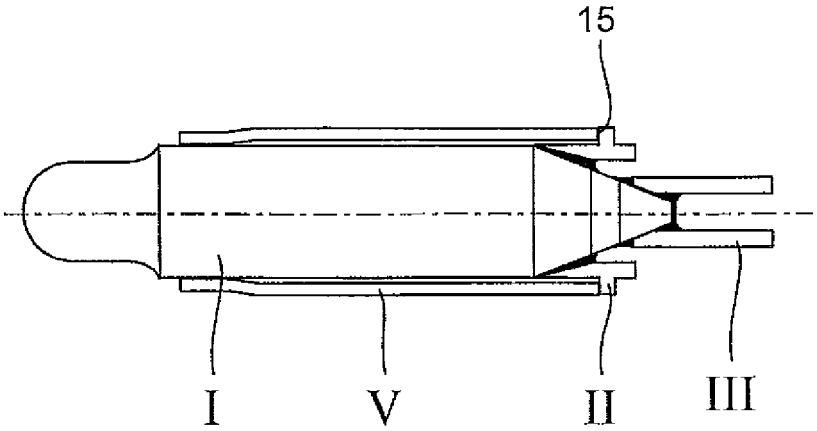
FIG. 22 shows a heater or glow pencil variant with contact ring and inner pole head and sleeve.

FIG. 7 shows a cylindrical glow pencil I without sleeve, with a contact ring IIb and a brazed or soldered-on inner pole head III. FIG. 8 shows a cylindrical glow pencil without sleeve, with a further exemplary embodiment of a contact ring IIc and an inner pole head III. FIG. 9 shows a cylindrical glow pencil without sleeve, with a contact ring IId and an inner pole head III and a solder buffer on the shaft of the inner pole head 10. FIG. 10 shows a heater or glow pencil variant with a contact ring II and an inner pole head III, wherein the glow pencil comprises a tip which is reduced in its diameter and has a so-called turned-on design. Further variants of FIGS. 10 to 34 are illustrated in FIG. 41.

FIGS. 8, 9, 10, 14, 18, 22, 26, 29, and 32 show butt-welding examples of laser welding for attaching the sleeve V.

Figure 23:
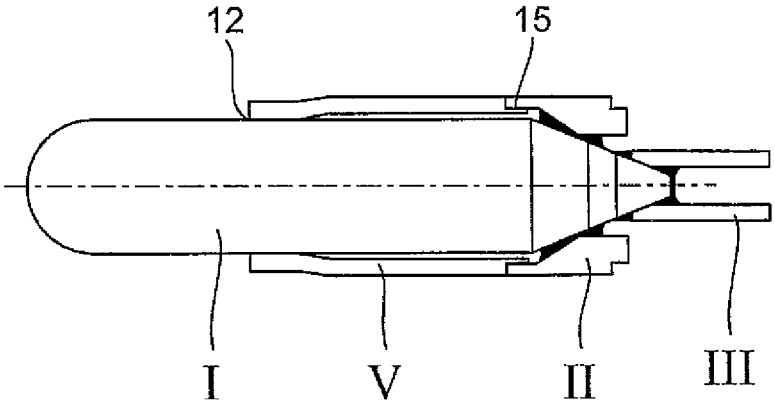
FIG. 23 shows a heater or glow pencil variant with contact ring and inner pole head and sleeve.
Figure 24:
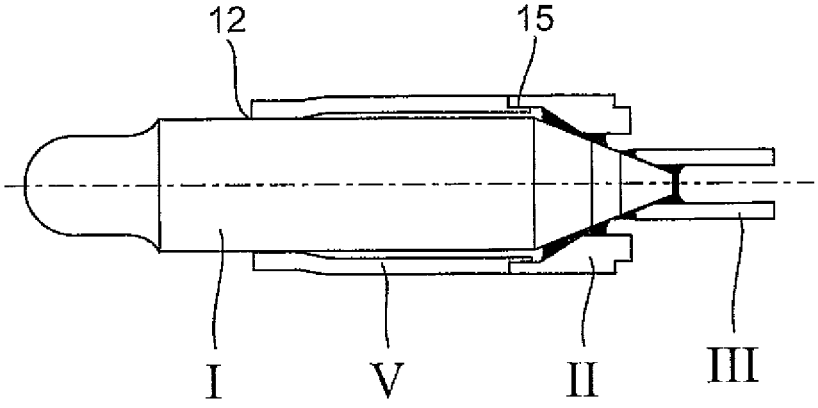
FIG. 24 shows a heater or glow pencil variant with contact ring and inner pole head and sleeve.
Figure 25:
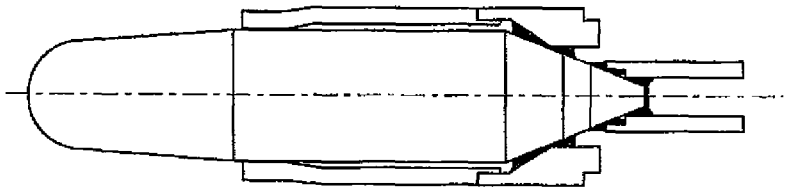
FIG. 25 shows a heater or glow pencil variant with contact ring and inner pole head and sleeve.
Figure 26:
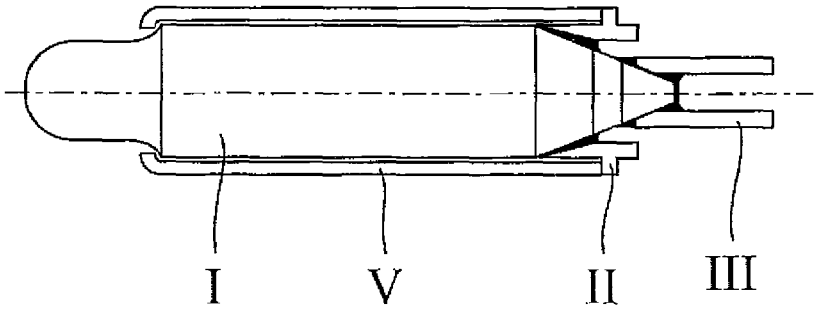
FIG. 26 shows a heater or glow pencil variant with contact ring and inner pole head and sleeve.
Figure 27:
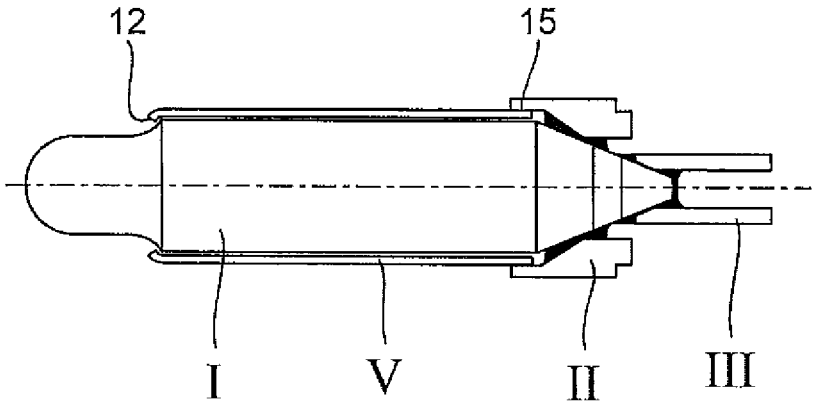
FIG. 27 shows a heater or glow pencil variant with contact ring and inner pole head and sleeve.
Figure 28:
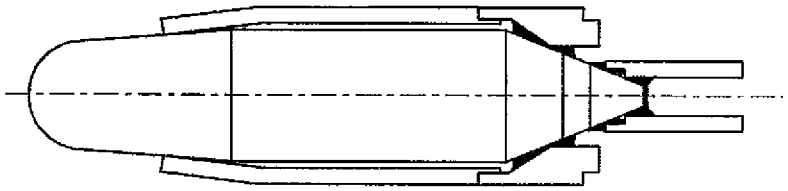
FIG. 28 shows a heater or glow pencil variant with contact ring and inner pole head and sleeve.
Figure 29:
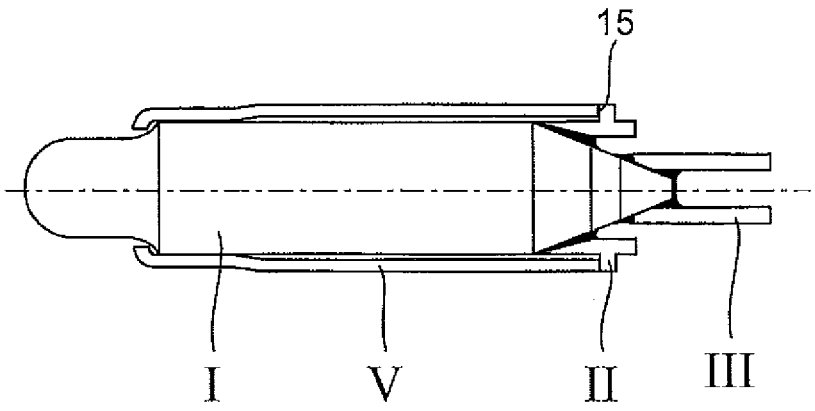
FIG. 29 shows a heater or glow pencil variant with contact ring and inner pole head and sleeve.
Figure 30:
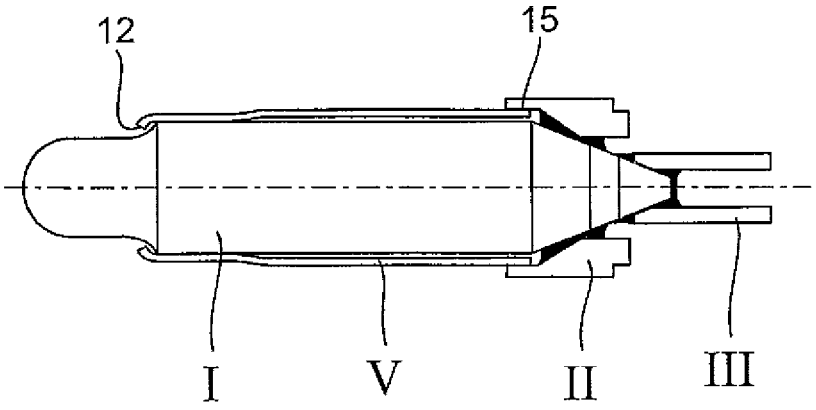
FIG. 30 shows a heater or glow pencil variant with contact ring and inner pole head and sleeve.
Figure 31:
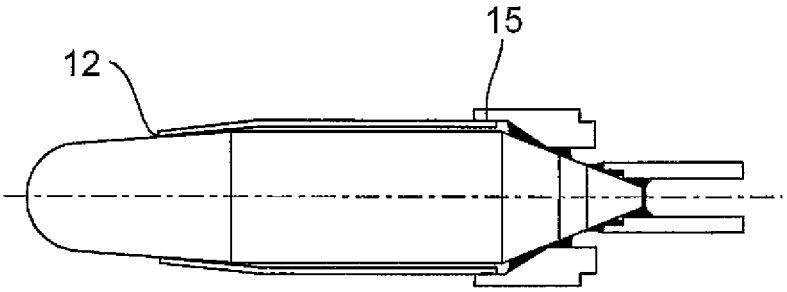
FIG. 31 shows a heater or glow pencil variant with contact ring and inner pole head and sleeve.
Figure 32:
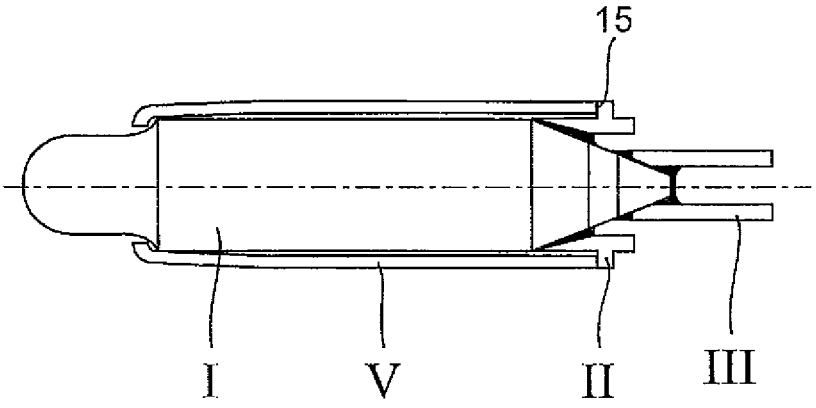
FIG. 32 shows a heater or glow pencil variant with contact ring and inner pole head and sleeve.
Figure 33:
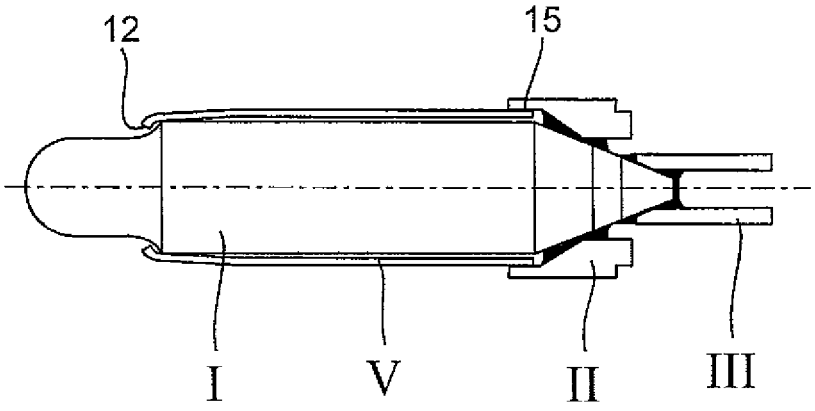
FIG. 33 shows a heater or glow pencil variant with contact ring and inner pole head and sleeve.
Figure 34:
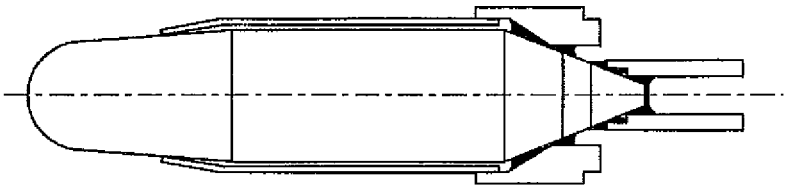
FIG. 34 shows a heater or glow pencil variant with contact ring and inner pole head and sleeve.
Figure 35:
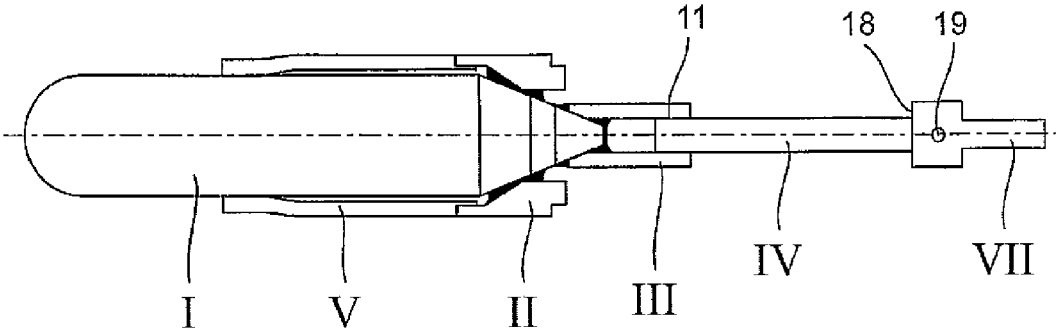
FIG. 35 shows a glow pencil with contact ring, inner pole head, sleeve, feed line, and glow current connection.
Figure 36:
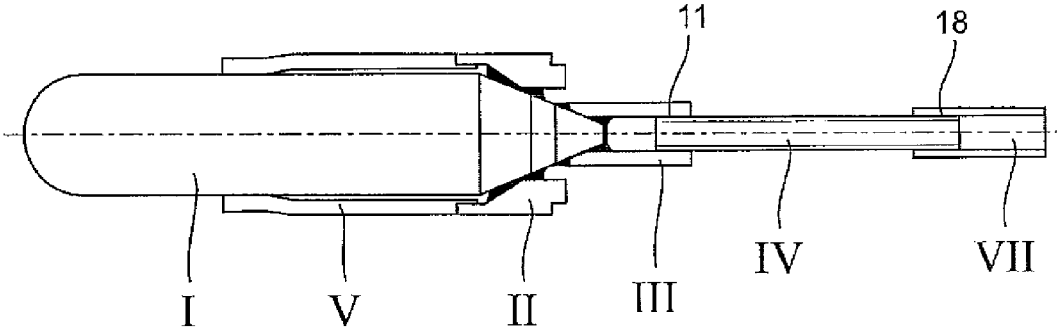
FIG. 36 shows a glow pencil with contact ring, inner pole head, sleeve, feed line, and glow current connection.

FIG. 35 shows the example of FIG. 23 with connected feed line in the form of a pencil as well as a glow current connection, with a hole for laser welding in the illustrated instance. FIG. 36 shows the example of FIG. 23, wherein the feed line IV is designed in the form of a cable which is arranged at the glow current connection VII that is arranged as sleeve.

Figure 37:
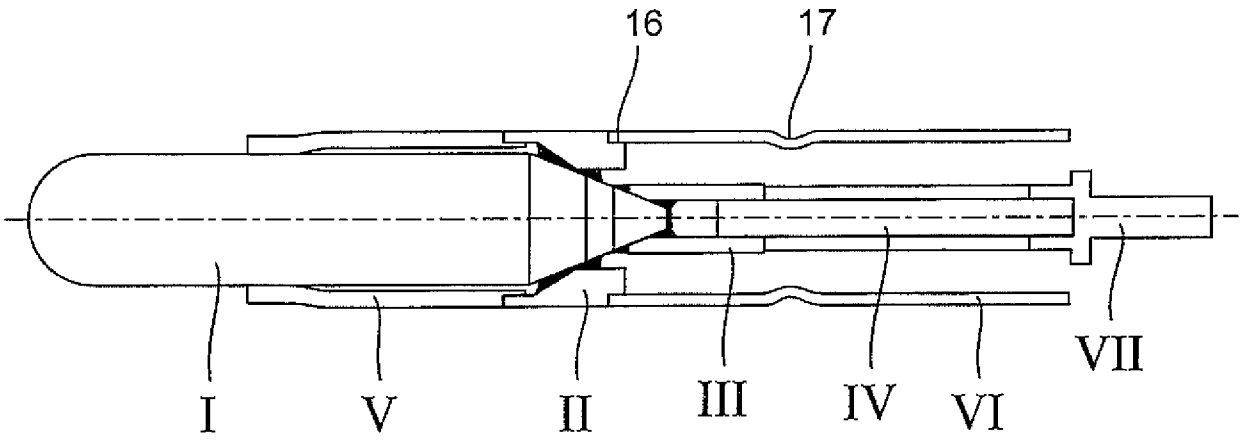
FIG. 37 shows a glow pencil with contact ring, inner pole head, sleeve, feed line, glow current connection, and extension.

FIG. 37 shows the example of FIG. 23 with connected feed line in the form of a cable, wherein the glow current connection is configured with a collar, to allow future molding in the sensor housing and extending as a simple tube section with reduction/drawing-in 17.

Figure 38:
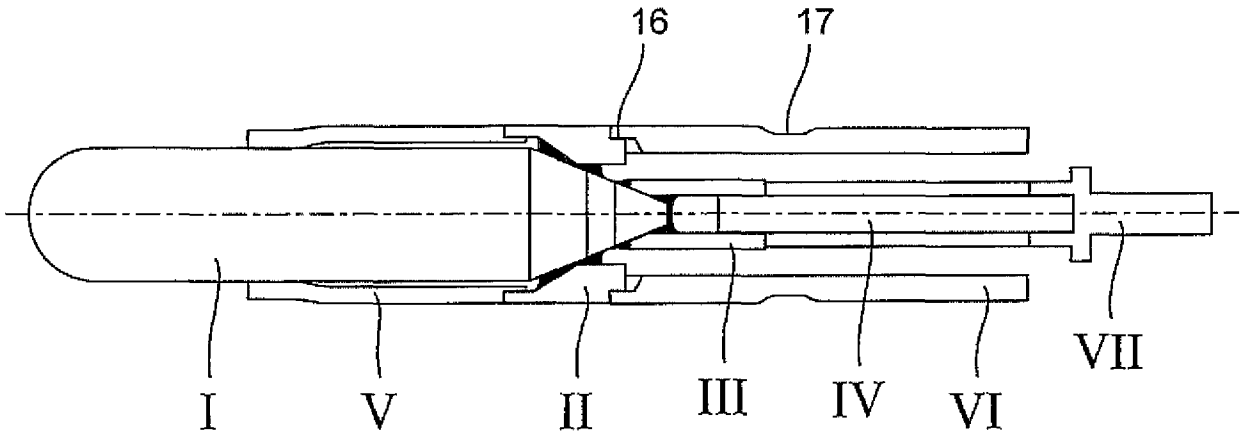
FIG. 38 shows a glow pencil with contact ring, inner pole head, sleeve, feed line, glow current connection, and extension.
Figure 39:
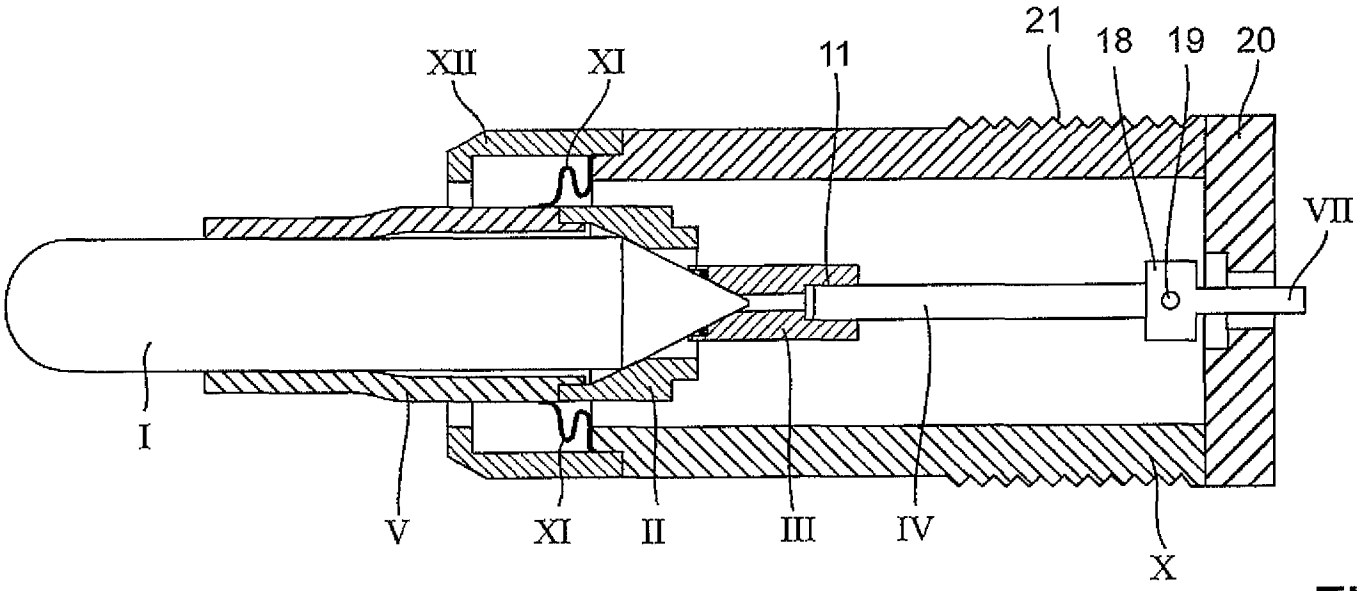
FIG. 39 is a sectional view of a further exemplary embodiment of a ceramic glow plug.

FIG. 38 shows the apparatus of FIG. 37, however, with an extension as tube section with turned-on section 17 and a hole for producing the joint region 16. FIG. 39 shows a glow plug which comprises the following elements: ceramic glow pencil contact ring II, inner pole head III, feed line IV, sleeve V, glow current connection VII, as well as an upper body part X configured as housing and a lower body part XII. A bellows-type seal is arranged between the housing and the sleeve V. A hexagon bolt 20 which is provided for assembly in the cylinder head is arranged at the end of the glow plug that is arranged opposite from the glow pencil I, wherein said hexagon bolt 20 can be used to turn the glow plug into the cylinder head by means of the thread 21 that is arranged on the lateral area of said hexagon bolt.

FIG. 39 shows schematically a further exemplary embodiment of a glow plug according to the invention with a somewhat simpler construction. While in the embodiment shown in FIG. 1 the contact element II is connected on one side to the sleeve V and on the other side to a further sleeve VI, the further sleeve is absent in the exemplary embodiment of FIG. 39.

A further difference relates to the configuration of the first end of the glow pen I and of the sleeve V. The glow pin is rounded at its first end and is cylindrical therefrom up to the tapered portion at the second end. The sleeve V lies against the glow plug I only on part of its length. A ring gap is formed between a portion of the sleeve V adjacent to the contact element II and the glow pin.

The housing part X has an external thread 21 and a hexagon 20 for screwing into a motor. Otherwise, this exemplary embodiment corresponds to the exemplary embodiment shown in FIG. 1, for which reason reference is made to the statements made there.

Figure 40:
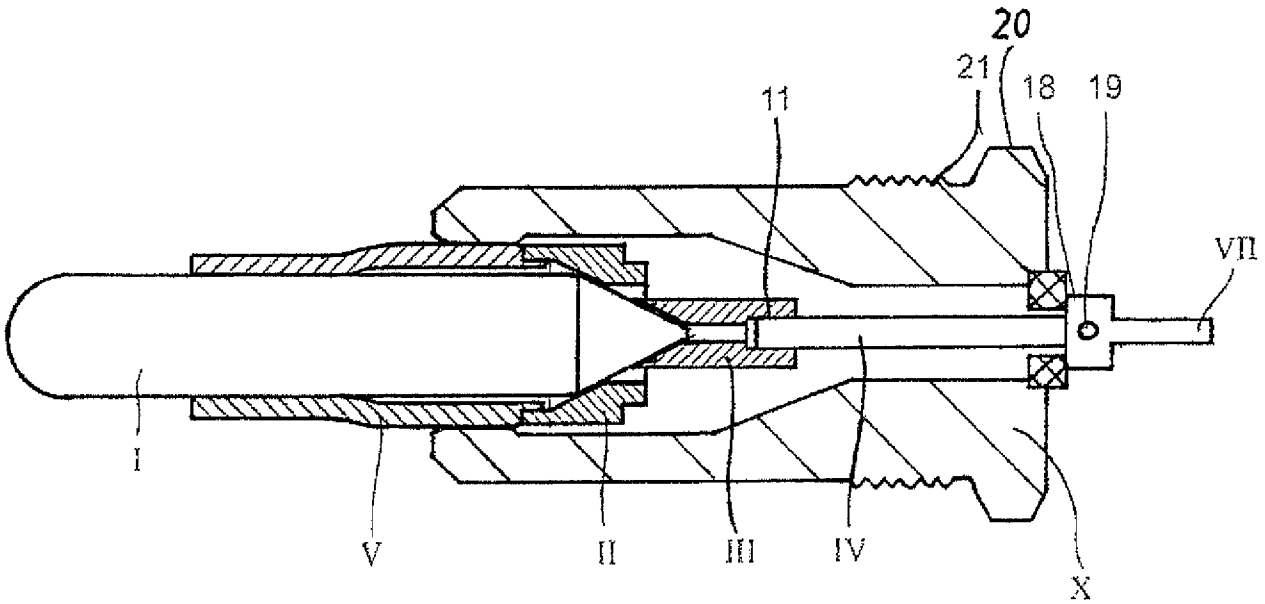
FIG. 40 is a sectional view of a further exemplary embodiment of a ceramic glow plug.

FIG. 40 shows schematically a further exemplary embodiment of a ceramic glow plug in a longitudinal section. The essential difference to the exemplary embodiment explained above with reference to FIG. 39 is that a one-part housing X is used. The sleeve V is pressed into the housing X. It is also possible to weld the sleeve V with the housing X.

The exemplary embodiment illustrated in FIG. 40 has the advantage of a simplified construction. However, the sleeve V is practically no longer movable relative to the housing X, so that this glow plug cannot be used as a pressure measuring glow plug. In the exemplary embodiment shown in FIG. 39, the glow pin together with the sleeve V attached to it can, however, be pushed into the housing X more or less far against a restoring force as a function of the combustion chamber so that the position of the glow plug I relative to the housing X a pressure measurement is possible.

REFERENCE SYMBOLS

I Ceramic glow pencil
II Contact ring
III Inner pole head
IV Feed line
V Sleeve
VI Extension
VII Glow current connection
VIII Sensor element with plug connection
IX Damping ring
X Upper body part
XI Bellows
XII Lower body part
1 Glow tip of the ceramic glow pencil
2 Feed line of the ceramic glow pencil
3 Connecting cone of the ceramic glow pencil
4 Connecting cone for the contact ring on the ceramic glow pencil
5 Isolator region at the connecting cone of the ceramic glow pencil
6 Connecting cone for the inner pole head on the ceramic glow pencil
7 Buffer for solder or brazing material on the cone of the contact ring
8 Buffer for solder or brazing material on the shaft of the contact ring
9 Buffer for solder or brazing material on the cone of the inner pole head
10 Buffer for solder or brazing material on the shaft of the inner pole head
11 Jointing hole for feed line at the inner pole head
12 Narrowed diameter at the sleeve
13 Tapered wall thickness at the sleeve
14 Original wall thickness of the sleeve
15 Joint region at the sleeve to the contact ring
16 Joint region at the extension to the contact ring
17 Guide region for damping ring at the extension
18 Joint region at the glow current connection
19 Welding hole at the glow current connection
20 Hexagon bolt
21 Thread

The invention claimed is:

1. A glow plug, comprising:

a housing;

a ceramic glow pencil having a first end projecting from the housing and a second end disposed in the housing, the ceramic glow pencil comprising an inner conductor and an outer conductor;

a feed line arranged in the housing and leading to the ceramic glow pencil; and a steel sleeve enclosing a first section of the ceramic glow pencil projecting from the housing;

wherein the ceramic glow pencil comprises a second section that is surrounded by the housing and tapered towards the second end; and a contact element disposed in the housing and around the second section of the ceramic glow pencil where the ceramic glow pencil projects through the contact element, wherein the contact element includes a narrowing section configured to surround the tapering of the second section of the ceramic glow pencil forming an electrical connection between the contact element and the second section of the ceramic glow pencil, and wherein an annular space between the contact element and the tapered second section comprises an increasing gap between the contact element and the second section of the ceramic glow pencil when moving away from electrical connection, where the annular space is configured to act as a buffer to accept a braze or a solder; and wherein the contact element is made from steel, wherein the steel of the sleeve is a different material in comparison to the steel of the contact element.

2. The glow plug according to claim 1 wherein the contact element is brazed or soldered to the ceramic glow pencil at the annular space.

3. The glow plug according to claim 1 wherein the contact element abuts to the sleeve.

4. The glow plug according to claim 1 wherein the contact element and the sleeve overlap each other.

5. The glow plug according to claim 1 wherein the feed line is surrounded by a second sleeve in the housing.

6. The glow plug according to claim 5, wherein the contact element abuts to the second sleeve.

7. The glow plug according to claim 5 wherein a vibration damper is arranged between the second sleeve and the housing.

8. The glow plug according to claim 1 wherein the sleeve is connected to the housing via a sealing element.

9. The glow plug according to claim 1 wherein the sleeve and the contact element are manufactured from different materials.

10. The glow plug according to claim 1 wherein the contact element comprises at least one cylindrical inner surface which is arranged adjacent to the narrowing section.

11. The glow plug according to claim 1 wherein the ceramic glow pencil is press-fitted into the sleeve.

12. The glow plug according to claim 1, wherein the contact element is welded to the sleeve.

13. The glow plug according to claim 1, further comprising a ceramic isolator, wherein the ceramic isolator is arranged between the inner conductor and the outer conductor.

14. A glow plug, comprising:

a housing;

a ceramic glow pencil having a first end projecting from the housing and a tapered section disposed in the housing, where the tapered section narrows towards a second end of the ceramic glow pencil, where the ceramic glow pencil comprises an inner conductor, a ceramic isolator and an outer conductor, wherein the ceramic isolator is arranged between the inner conductor and the outer conductor;

a sleeve enclosing a first section of the ceramic glow pencil projecting from the housing; and a contact element disposed in the housing and around the tapered section where the tapered section projects through the contact element, the contact element including a narrowing section configured to surround and abut the tapered section of the ceramic glow pencil forming an electrical connection between the contact element and the tapered section of the ceramic glow pencil, wherein an annular space between the contact element and the tapered section adjacent to the narrowing section comprises an increasing gap between the contact element and the tapered section of the ceramic glow pencil when moving away from the electrical connection, where the annular space is configured to act as a buffer to accept a braze or a solder;

wherein the contact element is welded to the sleeve.

15. The glow plug according to claim 14, wherein the contact element and the sleeve are made from steel, wherein the steel of the sleeve is a different material in comparison to the steel of the contact element.

16. A glow plug, comprising:

a housing;

a ceramic glow pencil having a first tapered end projecting from the housing and a second tapered end disposed in the housing, where the tapering of the first tapered end narrows towards the first end and where the tapering of the second tapered end narrows towards the second end, where the ceramic glow pencil comprises an inner conductor connected to an outer conductor;

a metallic sleeve around the first tapered end where the first tapered end projects through the sleeve and the sleeve is configured to be adjacent to the tapering of the first tapered end; and a contact element that is made from steel and disposed in the housing and around the second tapered end where the second tapered end projects through the contact element, the contact element including a narrowing section configured to surround and abut the second tapered end forming an electrical connection between the contact element and the second tapered end of the ceramic glow pencil;

wherein the sleeve and the contact element are separately manufactured and are made of different metallic materials; and wherein the sleeve and the contact element are configured to abut each other and are welded together when formed as the glow plug.

17. The glow plug according to claim 16, further comprising an annular space between the contact element and the second tapered end adjacent to the narrowing section where the annular space comprises an increasing gap between the contact element and the second tapered end of the ceramic glow pencil when moving away from the electrical connection, where the annular space is configured to act as a buffer to accept a braze or a solder.

18. The glow plug according to claim 17, including a braze or solder in the at least one circumferentially continuous annular space.

* * * * *